US010697128B2

(12) United States Patent
Li

(10) Patent No.: US 10,697,128 B2
(45) Date of Patent: Jun. 30, 2020

(54) METHOD AND APPARATUS FOR SWITCHING DEVICE

(71) Applicants: ALSTOM TRANSPORT TECHNOLOGIES, Saint-Ouen (FR); Bosheng Li, Shanghai (CN)

(72) Inventor: Bosheng Li, Shanghai (CN)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 303 days.

(21) Appl. No.: 15/566,519

(22) PCT Filed: Apr. 16, 2015

(86) PCT No.: PCT/CN2015/076757
§ 371 (c)(1),
(2) Date: Oct. 13, 2017

(87) PCT Pub. No.: WO2016/165109
PCT Pub. Date: Oct. 20, 2016

(65) Prior Publication Data

US 2018/0087223 A1 Mar. 29, 2018

(51) Int. Cl.

| | |
|---|---|
| ***E01B 7/02*** | (2006.01) |
| ***B61L 5/10*** | (2006.01) |
| ***B61L 5/02*** | (2006.01) |

(52) U.S. Cl.
CPC ..... *E01B 7/02* (2013.01); *B61L 5/02* (2013.01); *B61L 5/10* (2013.01); *E01B 2202/025* (2013.01)

(58) Field of Classification Search
CPC ..... E01B 7/00; E01B 7/02; E01B 7/06; E01B 7/08; B61L 5/00; B61L 5/02; B61L 5/04; B61L 5/06
See application file for complete search history.

(56) References Cited

U.S. PATENT DOCUMENTS 5,730,395 A * 3/1998 Carmes ..... B61L 5/10 246/448

FOREIGN PATENT DOCUMENTS

| | | |
|---|---|---|
| CN | 2494378 | 6/2002 |
| CN | 101870300 | 10/2010 |
| EP | 0802102 | 10/1997 |
| GB | 233285 | 5/1925 |

OTHER PUBLICATIONS

International Search Report for PCT/CN2015/076757, dated Jan. 21, 2016.
Written Opinion of the International Searching Authority for PCT/CN2015/076757, completed Jan. 15, 2016.

* cited by examiner

*Primary Examiner* — Robert J McCarry, Jr.
(74) *Attorney, Agent, or Firm* — B. Aaron Schulman, Esq.; Sites & Harbison, PLLC

(57) ABSTRACT

A method and apparatus for switching device, wherein the apparatus includes a clamp block (44) configured for attachment to a rail end point (12,14), the clamp block (44) including a housing (64) having a slot (66) formed therein, and a clip (42) configured to be received in the slot (66). The clip (42) disengageable from the slot (66) upon application of a generally lateral trailing force to the rail end point (12,14) in excess of a threshold value.

22 Claims, 12 Drawing Sheets

METHOD AND APPARATUS FOR SWITCHING DEVICE

FIELD OF THE INVENTION

Embodiments of the invention relate generally to switching devices. Other embodiments relate to a method and apparatus for maintaining the functionality of a railway switching device.

BACKGROUND OF THE INVENTION

As is commonly known, railway switch point assemblies include two rail end points which are tapered rail profiles capable of deflecting to move between two different positions in order to facilitate the correct alignment of the track components for the desired path of rolling stock transiting through the switch point assembly. The switch point assembly has two deflectable or movable rail end points which move in concert with one another between first and second alternative positions. In a first alternative position, a first one of these movable rail end points can be aligned with a first fixed stock rail to facilitate passage of the rolling stock straight through the switch point onto a first set of fixed rails. In a second alternative position, the second movable rail end point can be aligned with a second fixed stock rail to facilitate passage of the rolling stock onto a second set of fixed rails, such as to divert the rolling stock onto a siding.

In a typical switch point assembly, the two deflectable rail end points are moved by rods protruding from the opposite extremities of a unit often called a switch point machine. Inside the switch point machine, the rods are usually connected to a device with a reciprocating straight line motion, which is powered by a motor unit which is generally placed to the side of the rails. The state of the art includes numerous switch point machines for railway split point movements. Such mechanisms are normally installed at the switch point, and they are typically applied only to move the split rail end points of the switch point assembly.

Unless the switch is locked, a train coming from either of the converging directions may pass through the points, regardless of the position of the points, as the vehicle's wheels will force the points to move. Passage through a switch in this direction is known as a trailing-point movement.

In a trailing-point movement, the wheels will force the points to the proper position. This is sometimes known as running through the switch. If the points are rigidly connected to the switch control mechanism (e.g., a non-trailable switch machine), which is often desirable to ensure reliable operation, the switch mechanism's linkages may be bent, requiring repair before the switch is again usable. Certain switch machines may betrailable but are only acceptable for limited trailing forces and are only approved for limited speed, in stations or maneuver zones.

It may be desirable, therefor, to have a system and method that maintains the functionality of the switch point machine after trailing-point movements, without damage to the switch point assembly, switch point machine, fixed rails, etc.

BRIEF DESCRIPTION OF THE INVENTION

An embodiment of the invention relates to an apparatus. The apparatus includes a clamp block configured for attachment to a rail end point, the clamp block including a housing having a slot formed therein, and a clip configured to be received in the slot. The clip is disengageable from the slot upon application of a generally lateral trailing force to the rail end point in excess of a threshold value.

Another embodiment of the invention relates to an assembly. The assembly includes a first rail end point, a second rail end point, a switch machine configured to selectively move the first rail end point and second rail end point between first and second alternative positions, and a first clip assembly connecting a first end of the switch machine to the first rail end point. The first clip assembly is configured to transmit a pushing force from the switch machine to the first rail end point to move the first and second rail end points between the first and second alternative positions, and to automatically decouple the switch machine from the first rail end point during a trailing-point movement of a vehicle.

Yet another embodiment of the invention relates to a method. The method includes the steps of connecting a first rail end point to a switch machine via a first clip assembly, the first clip assembly being configured to transmit a pushing force from the switch machine to the first rail end point to selectively move the first rail end point between first and second alternative positions, and during a trailing-point movement of a vehicle, automatically decoupling the switch machine from the first rail end point.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
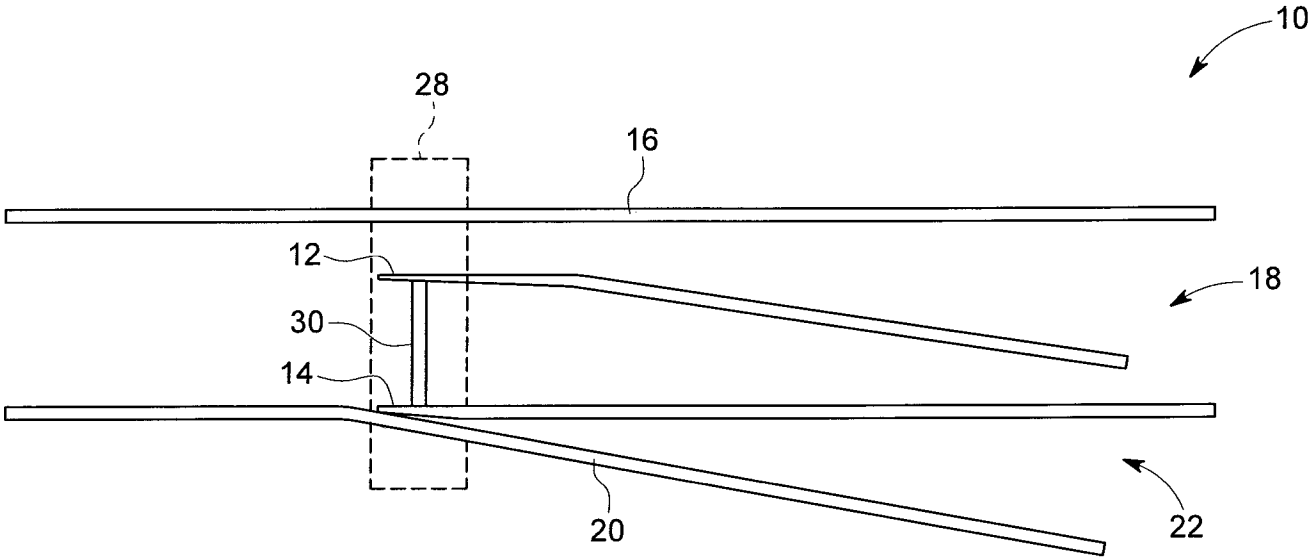
FIG. 1 is a schematic view of a railway switch point assembly.

Reference will be made below in detail to exemplary embodiments of the invention, examples of which are illustrated in the accompanying drawings. Wherever possible, the same reference numerals used throughout the drawings refer to the same or like parts. Although exemplary embodiments of the invention are described with respect torailway switch point machines, embodiments of the invention may also be applicable for use with switching devices, generally, including any device where both rigid and decoupling modes may be beneficial.

As used herein, "selectively coupled" means that a component may be coupled to another component in one mode of operation, and decoupled with the another component in another mode of operation.

Figure 2:
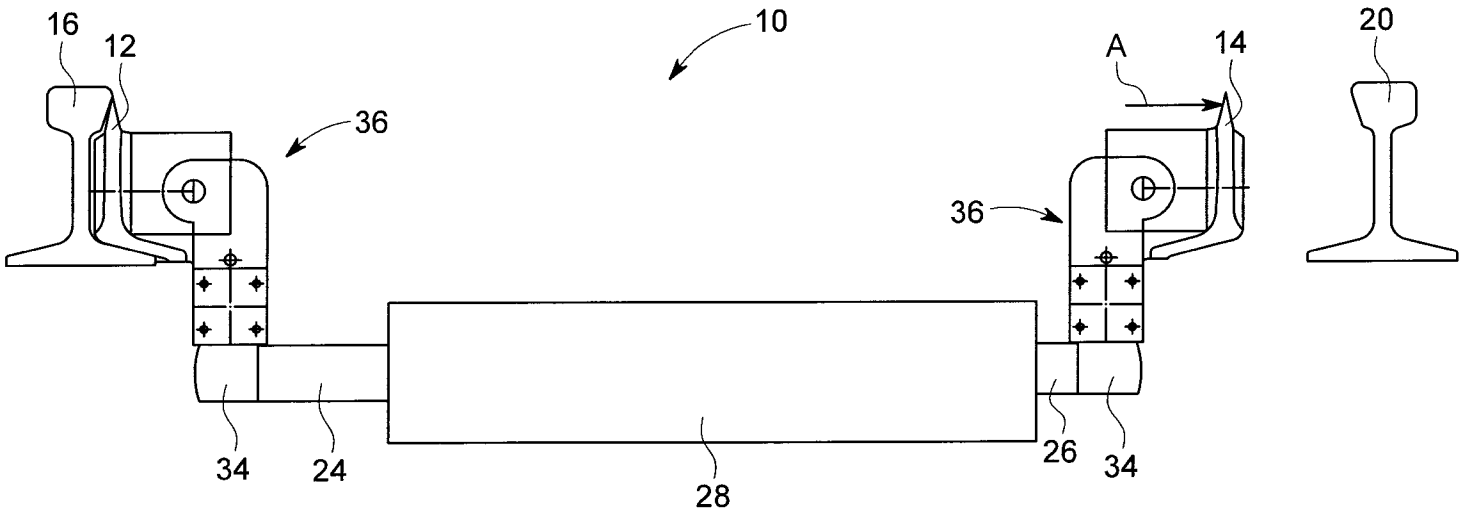
FIG. 2 is an enlarged, front-elevational view of the switch point assembly of FIG. 1.
Figure 3:
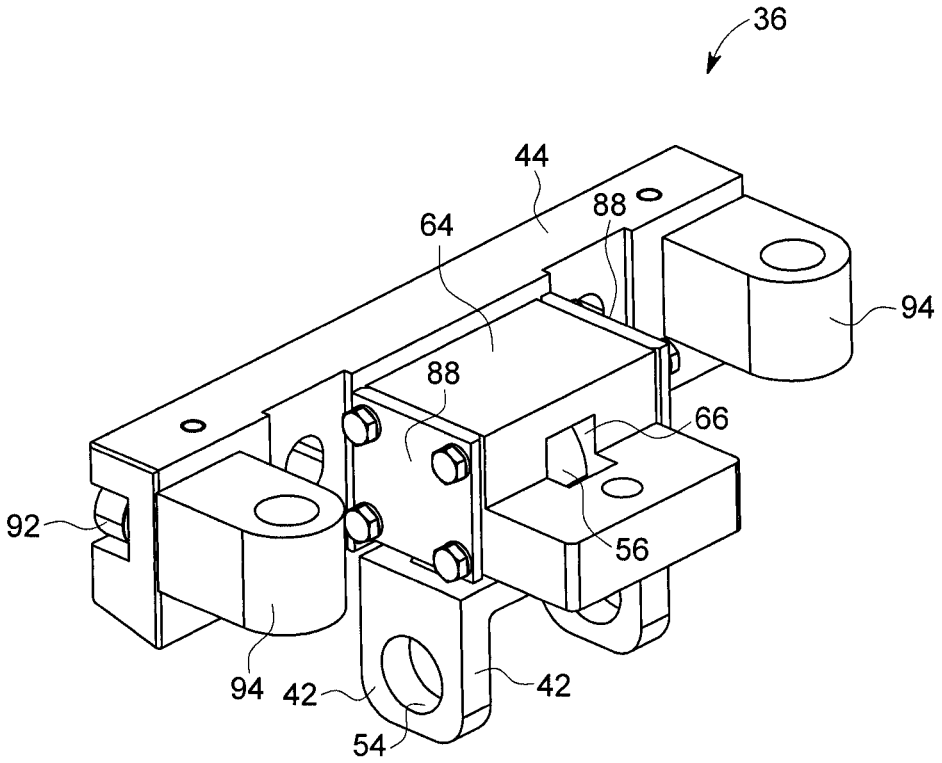
FIG. 3 is a perspective view of a clip for a switch machine of a railway switch point assembly, according to an embodiment of the invention.

With reference to FIGS. 1 and 2, a railway switch point assembly 10 includes two rail end points 12, 14. As discussed above, the rail end points 12, 14 are tapered rail profiles capable of deflecting to move between two different positions in order to facilitate the correct alignment of the track components for the desired path of rolling stock transiting through the switch point assembly 10. In particular, the switch point assembly 10 has two deflectable or movable rail end points 12, 14 which move in concert with one another between first and second alternative positions. In a first alternative position, shown in FIG. 1, a first one 12 of these movable rail end points 12, 14 can be aligned with (e.g., positioned parallel to) a first fixed stock rail 16 to facilitate passage of the rolling stock straight through the switch point onto a first set of fixed rails 18. In a second alternative position, the second movable rail end point 14 can be aligned with (e.g., positioned parallel to) a second fixed stock rail 20 to facilitate passage of the rolling stock onto a second set of fixed rails 22.

The two deflectable rail end points 12, 14 are moved by rods 24, 26 protruding from the opposite extremities of a unit called a switch point machine 28 (also referred to herein as a switch machine). Inside the switch point machine 28, the rods 26, 28 are usually connected to a device with a reciprocating straight line motion, which is powered by a motor unit which is generally placed to the side of the rails. In some configurations, a connecting rod or tie bar 30 may be utilized to tie the rail end points 12, 14 rigidly to one another. As shown in FIG. 2, a socket 34 is provided at the outer end of each rod 24, 26. Each rod socket 34 is pivotally connected to its associated rail end point 12, 14 by a clip assembly 36, as discussed in detail hereafter.

Figure 4:
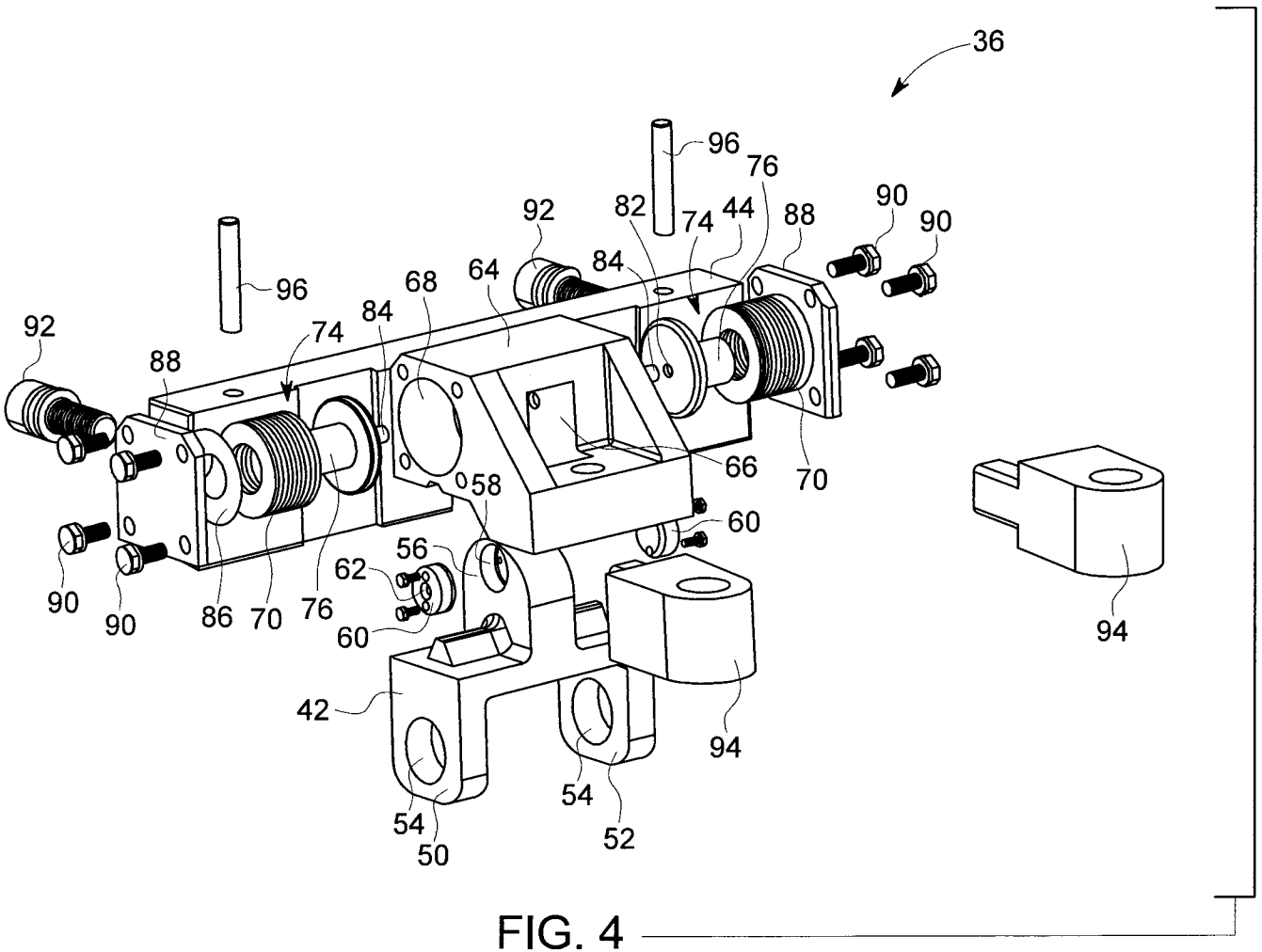
FIG. 4 is an exploded, perspective view of the clip of FIG. 3.
Figure 5:
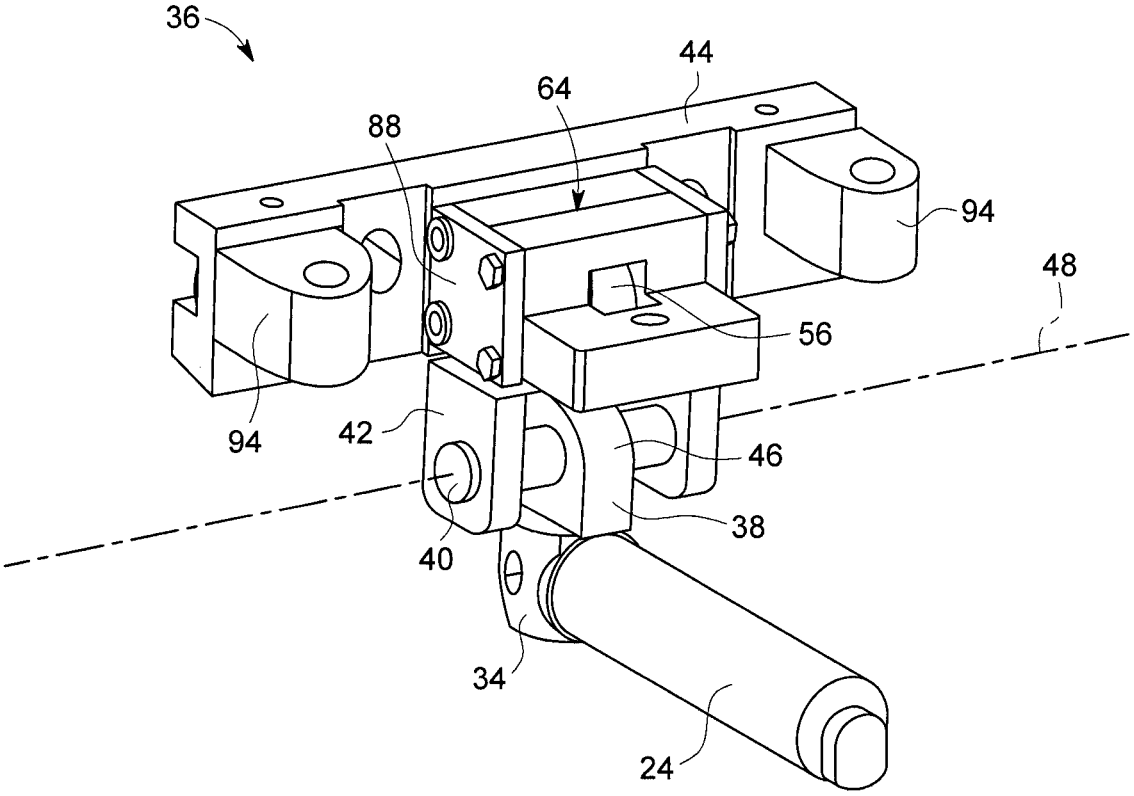
FIG. 5 is another perspective view of the clip of FIG. 3.
Figure 6:
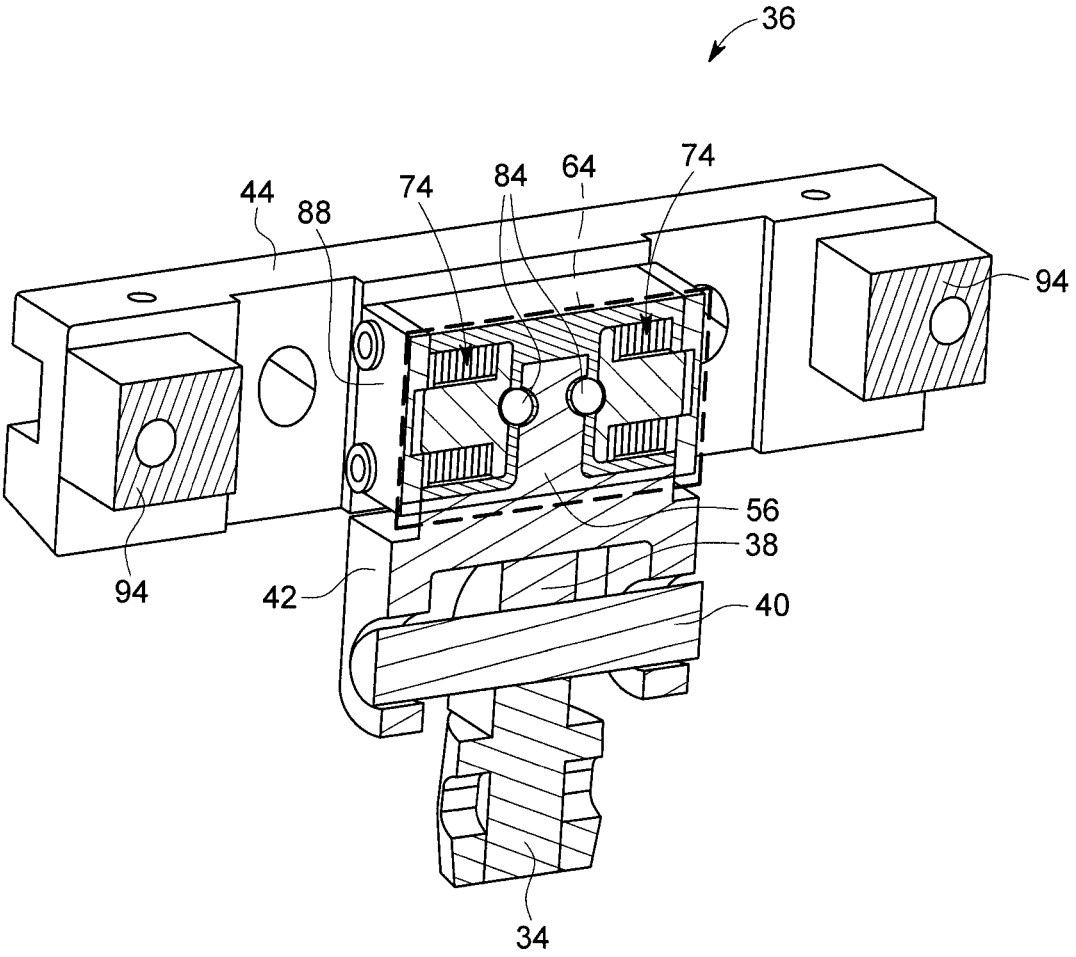
FIG. 6 is a cross-sectional view of the clip of FIG. 3.

As illustrated in FIGS. 3-6, eachclip assembly 36 includes a yoke 38, a pivot pin 40, a clip 42, and a clamp block 44. As best shown in FIG. 5, the yoke 38 extends substantially vertically from the socket 34 and includes a collar 46 having a horizontal bore centered on a horizontal axis 48 of the pivot pin 40. The clip 42 is generally U-shaped and has a pair of opposed first and second depending legs 50, 52, each having a horizontal bore 54 therethrough centered on the horizontal axis 48 of the pivot pin 40. The clip 42 and yoke 38 are, therefore, both configured to pivot about horizontal axis 48 when the pivot pin 40 is received by the bore of the collar 46 and the bores in the legs 50, 52 of the clip 42. The clip 42 also includes an upwardly extending third leg 56 having recesses 58 formed on opposing sides thereof, as best illustrated in FIG. 4. The recesses 58 are sized to receive inserts 60 having an outwardly facing detent recess 62. In an embodiment, the inserts 60 may be secured within the recesses 58 of the clip 42 by screws or other suitable fasteners. In other embodiments, the detent recesses may be formed in outward facing surfaces of the third leg 56 of the clip 42 (where the recesses 58 and inserts 60 may be omitted).

Figure 7:
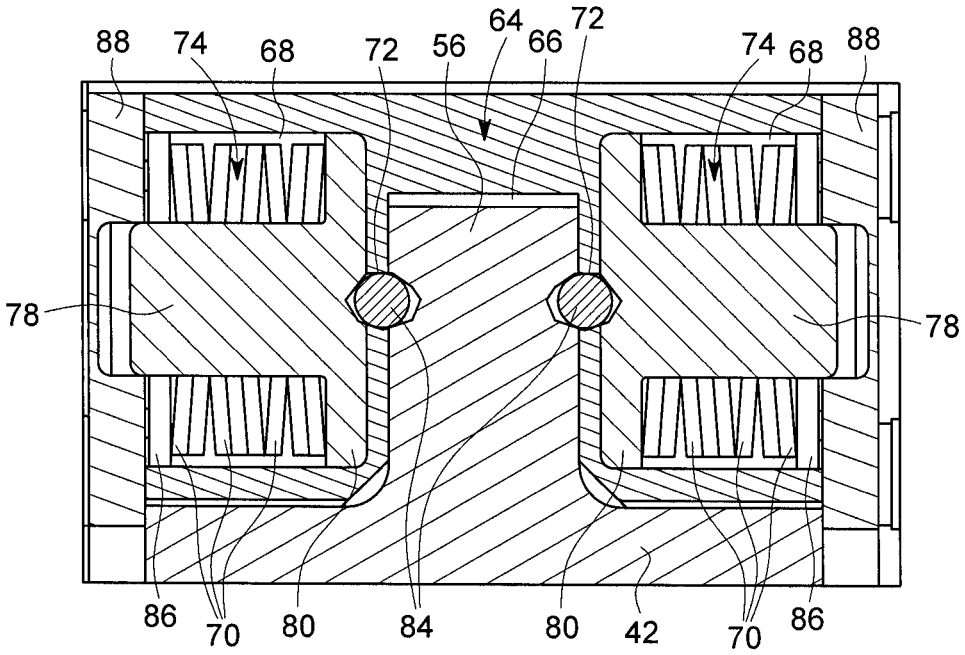
FIG. 7 is an enlarged, cross-sectional view of a clip-retaining mechanism of the clip of FIG. 3.

With further reference to FIG. 4, the clamp block 44 includes a generally rectangular piece of stock having housing portion 64 protruding laterally from one side thereof. The housing portion 64 of the clamp block 44 includes a slot 66 formed therein that is sized and shaped to closely receive the third, upwardly extending leg 56 of the clip 42. The opposed, lateral sides of the housing portion 64 include cylindrical recesses 68 that are configured to receive disc springs 70 therein, as discussed hereinafter. As best shown in FIG. 7, a ball aperture 72 located at the bottom of each recess 68 provides a passageway through the bottom wall of each recess 68 to the slot 66. In an embodiment, the ball apertures 72 are generally circular in shape.

Referring once again to FIG. 4, the recesses 68 are each configured to receive a respective spring-biased clip retaining mechanism 74. The clip retaining mechanism 74 includes a t-shaped shaft 76 having a shaft portion 78 (see FIG. 7) and a disc-shaped head portion 80. The head portion 80 is formed with a small depression 82 in the outer surface thereof opposite the shaft and centered axially about the longitudinal axis of the shaft 78. The mechanism 74 also includes a detent ball 84. The detent ball 84 is sized to be able to pass through ball apertures 72 at the bottom of the cylindrical recesses 68 and is located axially with respect to t-shaped shaft 76 by engagement with depression 82. The mechanism 74 further includes disc springs 70 which may comprise a plurality of conical spring washers that are received on the shaft portion 78 of t-shaped shaft 76, as well as a disc shaped adjustment plate 86 that is likewise received on the shaft portion 78 and which, in combination with the head portion 80 of the t-shaped shaft, sandwiches the disc springs 70 therebetween. Each clip retaining mechanism 74 is received fully within the respective recesses 68 in the housing 64 and is itself retained in place by flange plates 88 that may be secured to the housing with threaded bolts 90 or other suitable fasteners.

Turning now to FIG. 7, the arrangement of components of the clip retaining mechanism 74 is best illustrated. As shown therein, the detent balls 84 are positioned within the ball apertures 72 in the bottom of the recesses 68 and are held in place by the head portion 80 of the t-shaped shaft 76. The disc springs 70 are received on shaft portion 78 of the shaft, along with adjustment plate 86, and are held in place by flange plates 88 that are secured to the housing 64 of the camp 44. As shown in FIG. 7, the disc springs 70 bias the head portion 80 of the t-shaft 76 towards the bottom of the recess 68. This, in turn, causes the head portion 80 of the t-shaft 76 to bias the detent balls 84 towards the clip 42 such that the detent balls 84 are urged through the ball apertures 72 into the detent recesses 62 in the third leg 56 of the clip 42, thereby retaining the clip 42 in place. In particular, the detent balls 84 are urged into the detent recesses 62 in the clip 42 by the disc springs 70, which prevents the clip 42 from sliding out of the slot 66 in the housing 64 of the clamp block 44.

Figure 8:
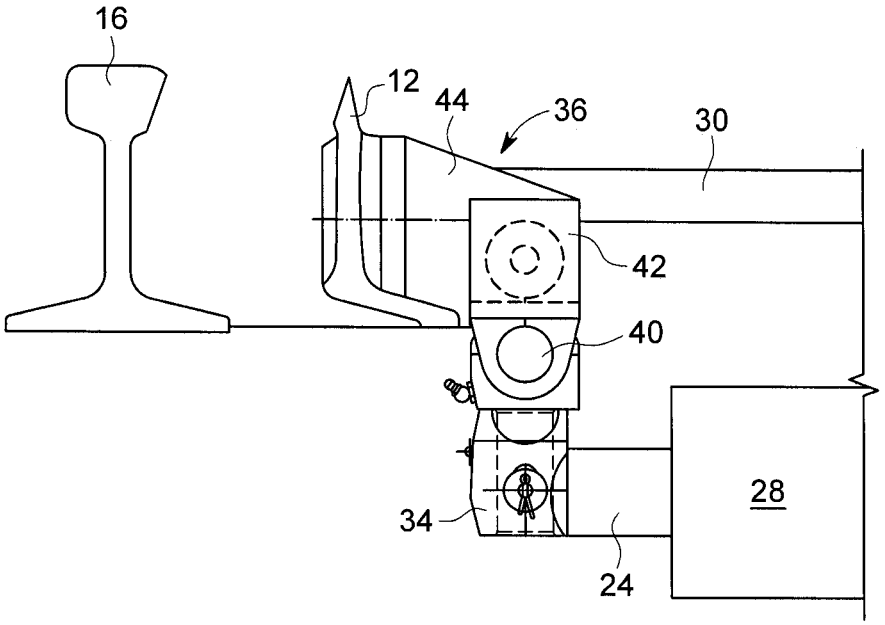
FIG. 8 is an enlarged, front, cross-sectional view of the switch point assembly of FIG. 2, illustrating engagement of the clip with a point rail of the switch-point assembly.
Figure 9:
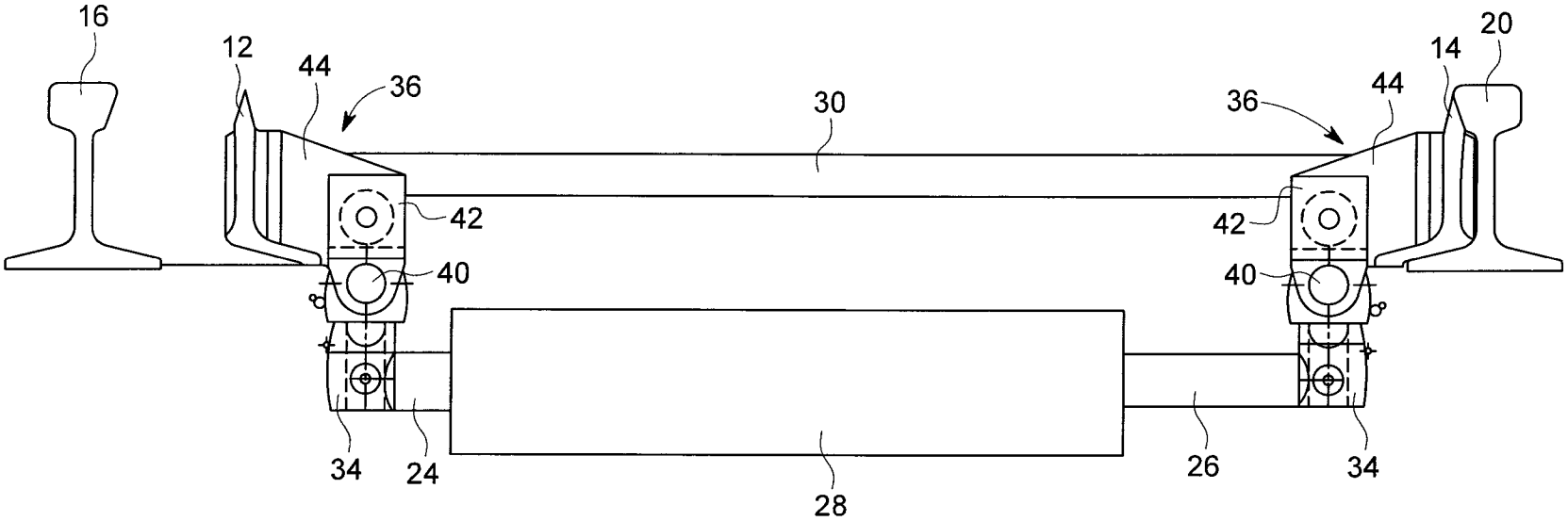
FIG. 9 is a front, cross-sectional view of the switch point assembly, illustrating normal operation.

As illustrated in FIGS. 2, 4 and 8, each clamp block 44 may be secured to the inside surface of a respective rail end point 12, 14 via threaded bolts 92. In particular, each clamp block 44 may be placed on a respective inside surface of one of the rail end points 12, 14 and secured thereto by passing a threaded bolt 92 from an outwardly facing surface thereof through an aperture formed in the rail end point 12, 14 such that the bolt 92 is received in a corresponding threaded bore (not shown) formed in the rear surface of the clamp block 44. As also shown in FIG. 4, the clamp block 44 may include a pair of connecting blocks 94 that are mounted to the clamp block 44 via dowel pins 96. In an embodiment, the bolts 92 may be received by corresponding threaded bores formed in the rear side of the connecting blocks 94. The connecting blocks 94 serve as a mounting means for the connecting rod 30 that spans the rail end points 12, 14 and rigidly locks the end points together.

During normal operation, for facing-point movements, the switch machine 28 is selectively operable to control the rail end points 12, 14 between the first and second alternative positions to direct the rolling stock either straight through the switch point onto the first set of fixed rails 18 or to divert the rolling stock onto a second set of fixed rails 22. In particular, the rods 26, 28 of the switch machine 26, 28 are selectively extendable to move the rail end points 12, 14 between the first and second positions. As one of the rods 26, 28 is extended, the outward pushing force from the rod is transmitted to the adjacent rail end point 12, 14 through the clip assembly 36. Indeed, during facing-point movements, the clip 42 is configured to maintain a reliable and rigid connection to allow for movement of the rail end points 12, 14 to the desired orientation. More specifically, the disc springs 70 of the clip retaining mechanism 74 provide a large pre-setting compression force to provide the required rigidity of the entire switch point assembly 10 necessary to move and lock the rail end points 12, 14. In this respect, the assembly 10 of embodiments of the invention offers the same functionality during facing-point movements as existing assemblies. In particular, during normal operation, the assembly 36 is configured to lock the rail end points 12, 14 into location with high forces to minimize derailments.

Figure 10:
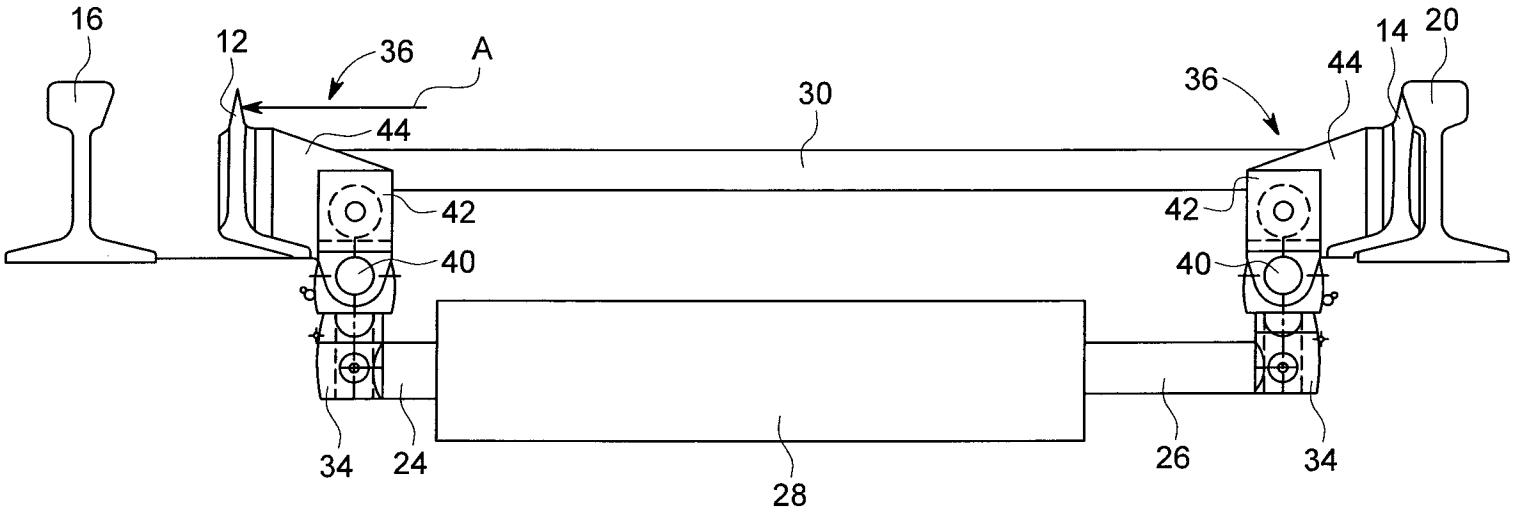
FIGS. 10 and 11 are front, cross-sectional views of the switch point assembly, illustrating a trailing operation.
Figure 11:
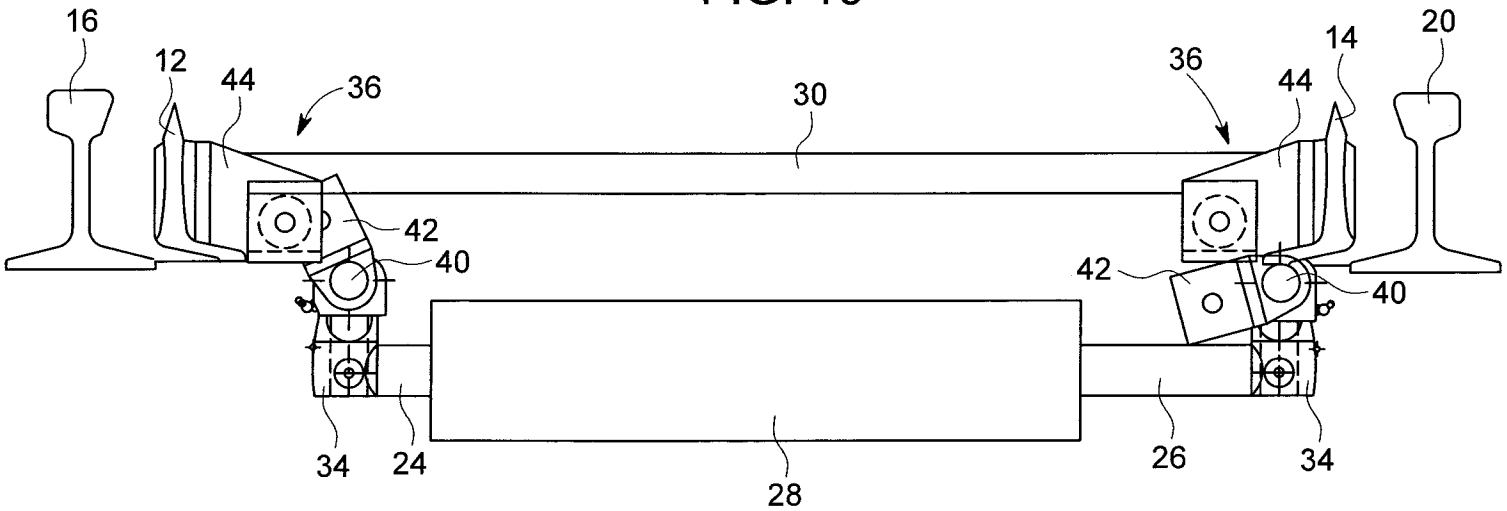

With reference to FIGS. 10 and 11, during trailing-point movements, however, the wheels of the rolling stock may exert a lateral force on one of the rail end points 12 and urge the rail end point 12 away from its locked position. The trailing force exerted on rail end point 12 is represented by arrow A. As discussed above, with existing switch point assemblies, this trailing force may damage the switch point machine and its components, especially in cases where the rail end points 12, 14 are locked in position. Embodiments of the invention, however, allow for the automatic decoupling of the switch point machine 28 from the rail end point 12 to which the trailing force A is exerted, thereby preventing damage to the switch point machine 28 and its components. In particular, as the trailing force A is exerted on the rail end point 12 and the rail end point 12 moves in the direction of the trailing force, the trailable clip 42 is configured to disengage from the slot 66 in the housing 64 to prevent the trailing force from being transferred to the switch point machine 28 and its components. This decoupling functionality is best illustrated in FIG. 11.

Figure 12:
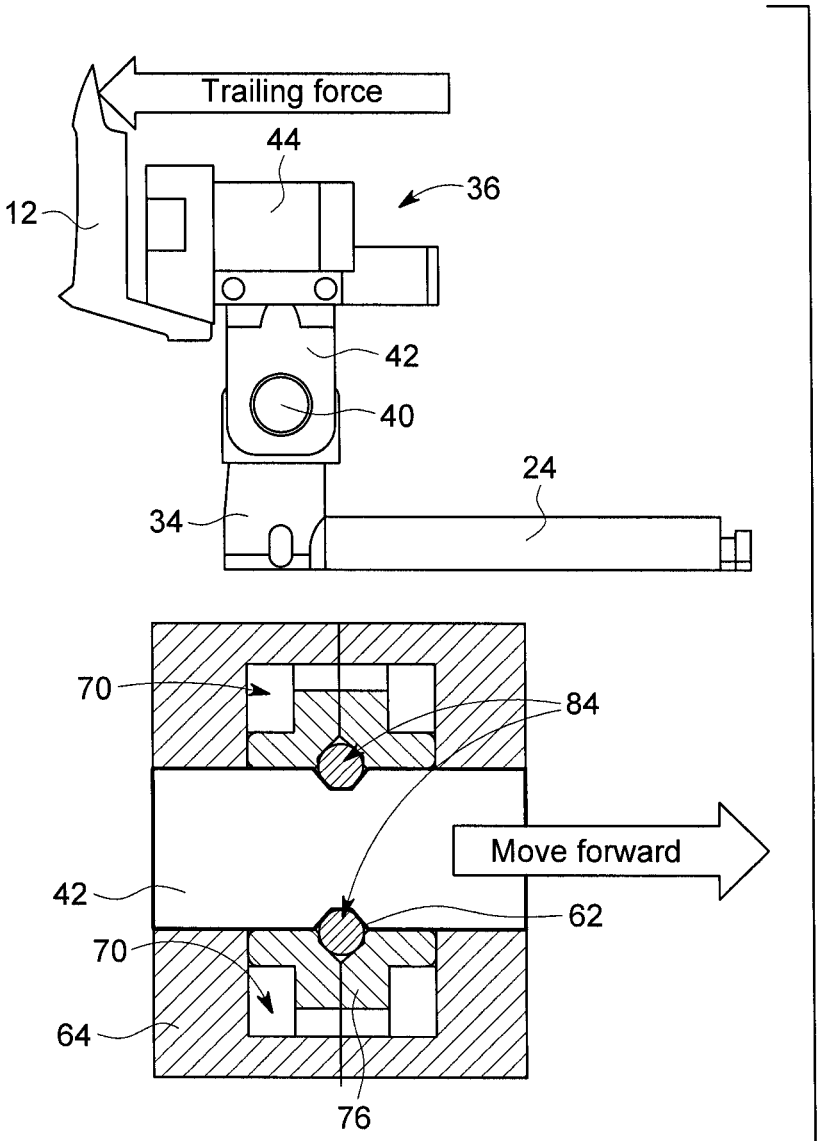
FIGS. 12-14 illustrate the clip of FIG. 3 during trailing operation, and show the corresponding positions of a clip retaining mechanism during such trailing operation.
Figure 13:
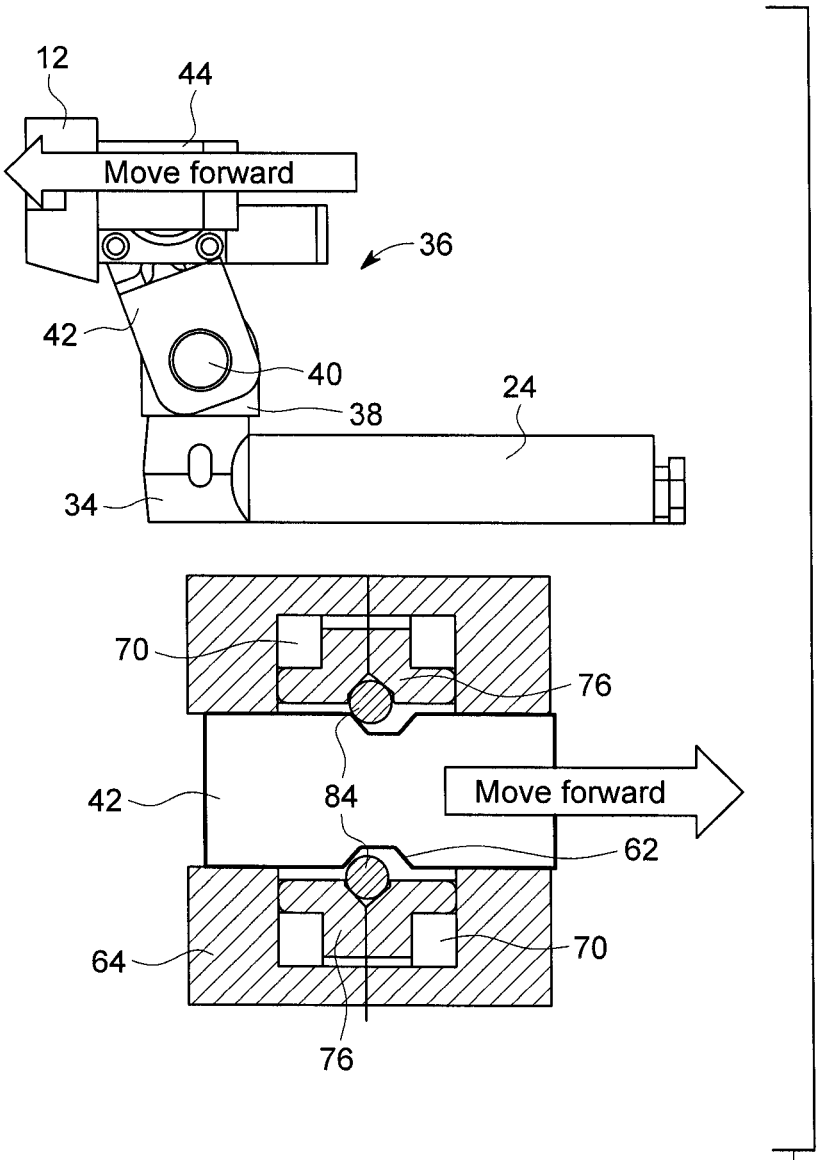
Figure 14:
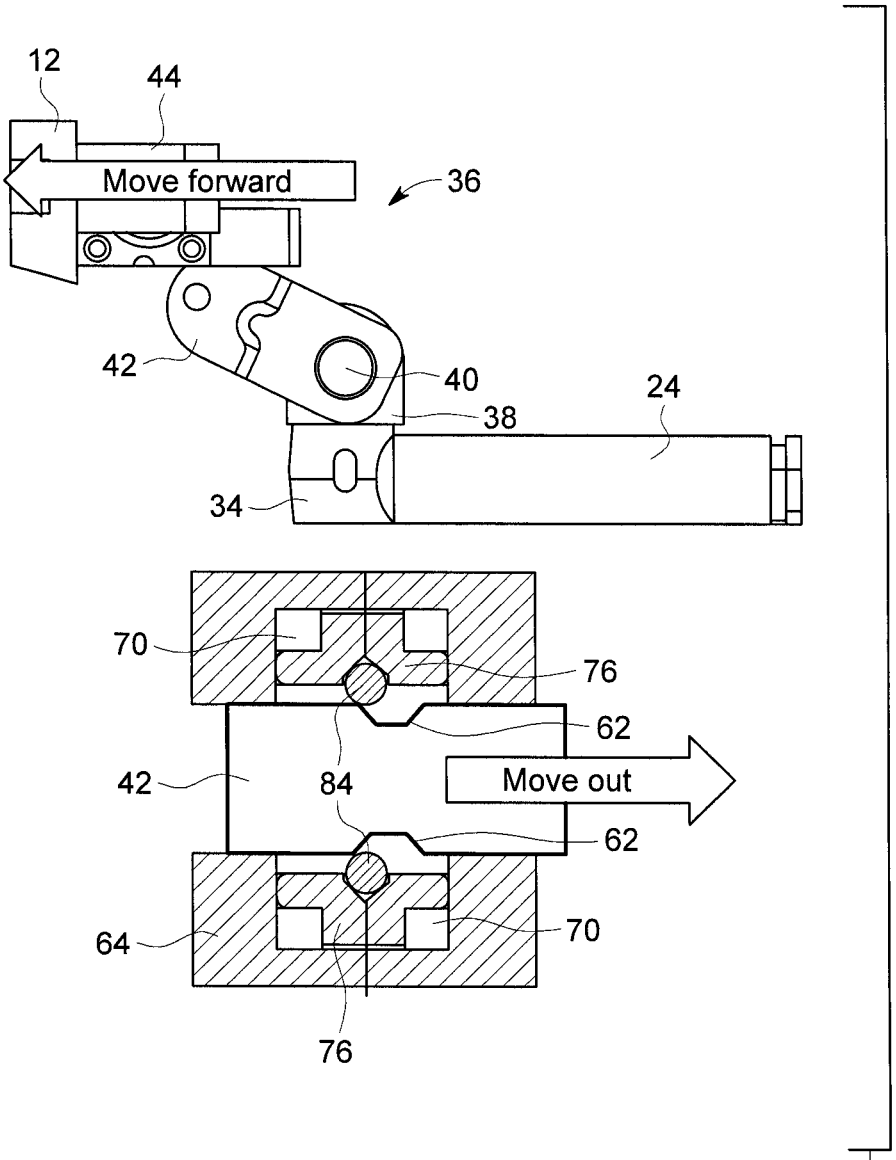

Turning now to FIGS. 12-14, detail views of the clip assembly 36 and corresponding operation of the clip retaining mechanism 74 during a trailing-point movement are shown. As shown in FIG. 12, during normal operation, clip 42 is retained in slot 66 by detent balls 84 that are urged into recesses 62 by the disc springs 70 of the clip retaining mechanism 74. In particular, the clip 42 is clamped tightly from opposing sides by the disc springs 70 to retain the clip 42 in place.

As the rail end point 12 is pushed outward by the trailing force, however, the clip 42 begins to rotate about the pivot pin 40, as shown in the upper portion of FIG. 13. During this movement, the clamp block 44 begins to pull away from the clip 42, causing the clip 42 to begin to slide out of the slot 66, as illustrated in the lower portion of FIG. 13. During this movement, the detent balls 84 begin to climb the walls of the recesses 62, which urges the detent balls 84 against the large spring bias of the disc springs 70. Continued movement of the rail end point 12 in the direction of the trailing force causes the further disengagement of the clip 42 from the slot 66, such that the detent balls 82 become fully disengaged from their seated positions within recesses 62, and they are urged further against the spring bias of the disc springs 70, as illustrated in FIG. 14. Once the detent balls 84 are disengaged from the recesses 62 in the clip 42, the clip 42 is generally free to slide out of the slot 66 and disengage from the housing 64 upon continued application of the trailing force. By providing for the automatic decoupling of the switch machine 28 from the rail end point to which the trailing force is applied, damage to the switch machine 28 may be prevented during trailing-point movements. In an embodiment, the switch machine may disengage from both rail end points 12, 14 during trailing-point movements (upon application of a lateral trailing force A to one of the rail end points 12, 14), as illustrated in FIG. 11.

As will be readily appreciated, the trailable clip assembly 36 is compact in design and is able to maintain a reliable and rigid connection between the switch machine and point rails under normal operation, while also being able to disconnect the switch machine from the point rail in trailing operation. In particular, the forces typically encountered during normal operation are not sufficient to cause the clip 42 to decouple from the clamp block 44, as such forces are much less than those seen during trailing operation. The trailable clip 42 is, however, configured to reliably decouple when subjected to the much larger forces during trailing operation. The force at which the clip 42 disengages from the housing 64 rather than move in concert with the clamp block 44 is referred to herein as the threshold force. In an embodiment, the threshold force value is at least 20,000 pounds (at least 88,000 newtons). This is in contrast to existing systems which utilize a clip that is incapable of disengaging from the point rail/rail end point without damage. As a result, in one aspect, the assembly maintains the integrity and functionality of the rail end points, the switch machine, and the rolling stock even after trailing-point movements Moreover, the simplicity of the design of the trailable clip assembly 36 allows for quick and easy replacement in the field. In addition, the reduction in parts as compared to existing assemblies translates to a reduction in costs and an ease of replacement and servicing.

An embodiment of the invention relates to an apparatus. The apparatus includes a clamp block configured for attachment to a rail end point, the clamp block including a housing having a slot formed therein, and a clip configured to be received in the slot. The clip is disengageable from the slot upon application of a generally lateral trailing force to the rail end point in excess of a threshold value. In an embodiment, the clip is generally U-shaped and includes a pair of opposed depending legs each having an aperture formed therein adjacent to respective distal ends thereof for receiving a pivot pin, and an upwardly extending third leg. The third leg is configured to be received in the slot in the housing of the clamp block. In an embodiment, the apparatus includes a clip retaining mechanism configured to retain the clip within the slot. The clip retaining mechanism may include at least one detent ball and a biasing mechanism configured to bias the at least one detent ball into engagement with a corresponding detent recess in the clip. In an embodiment, the biasing mechanism is at least one disc spring. In an embodiment, the clip retaining mechanism is positioned within the housing of the clamp block. In an embodiment, the apparatus may include a second clip retaining mechanism configured to retain the clip within the slot. The second clip retaining mechanism is positioned within the housing on an opposing side of the clip from the clip retaining mechanism and includes at least one second detent ball and a second biasing mechanism configured to bias the at least one second detent ball into engagement with a corresponding second detent recess in the clip. In an embodiment, the apparatus includes a connecting block engageable with the clamp block. The connecting block is configured to facilitate the attachment of a connecting rod between the clamp block and an opposing clamp block. In an embodiment, the apparatus is configured to couple the rail end point to a switch machine. In an embodiment, the clip is configured to maintain a rigid connection with the clamp block sufficient to transfer a pushing force from the switch machine to the rail end point, wherein the pushing force of the switch machine is below the threshold value.

Another embodiment of the invention relates to an assembly. The assembly includes a first rail end point, a second rail end point, a switch machine configured to selectively move the first rail end point and second rail end point between first and second alternative positions, and a first clip assembly connecting a first end of the switch point machine to the first rail end point. The first clip assembly is configured to transmit a first pushing force from the switch machine to the first rail end point to move the first and second rail end points between the first and second alternative positions, and to automatically decouple the switch machine from the first rail end point during a trailing-point movement of a rolling vehicle. In an embodiment, the assembly also includes a second clip assembly connecting a second end of the switch point machine to the second rail end point. The second clip assembly is configured to transmit a second pushing force from the switch machine to the second rail end point to move the first and second rail end points between the first and second alternative positions, and to automatically decouple the switch machine from the second rail end point during the trailing-point movement of the rolling vehicle. In an embodiment, the first clip assembly and second clip assembly each include a clamp block configured for attachment to a respective one of the first and second rail end points, each clamp block including a housing having a slot formed therein, and a clip configured to be received in the slot. The clip is disengageable from the slot upon application of a generally lateral trailing force to one of the first and second rail end points during the trailing-point movement. In an embodiment, each clip is generally U-shaped and includes a pair of opposed depending legs each having an aperture formed therein adjacent to respective distal ends thereof for receiving a pivot pin, and an upwardly extending third leg, wherein the third leg is configured to be received in the slot in the housing of the clamp block. The first and second clip assemblies may each include a clip retaining mechanism configured to retain the clip within the slot, the clip retaining mechanism including at least one detent ball and a biasing mechanism configured to bias the at least one detent ball into engagement with a corresponding detent recess in the clip. In an embodiment, the biasing mechanism is at least one disc spring. In an embodiment, the first and second clip assemblies each include a connecting block engageable with each clamp block, the connecting blocks being configured to facilitate the attachment of a connecting rod between the first clip assembly and the second clip assembly. In an embodiment, each clip is configured to maintain a rigid connection with the respective clamp block sufficient to transfer the pushing force from the switch machine to the first or second rail end point.

Yet another embodiment of the invention relates to a method. The method includes the steps of connecting a first rail end point to a switch machine via a first clip assembly, the first clip assembly being configured to transmit a pushing force from the switch machine to the first rail end point to selectively move the first rail end point between first and second alternative positions, and during a trailing-point movement of a vehicle, automatically decoupling the switch machine from the first rail end point. In an embodiment, the method may also include the steps of connecting a second rail end point to the switch machine via a second clip assembly, the second clip assembly being configured to transmit a second pushing force from the switch machine to the second rail end point to selectively move the second rail end point, and during the trailing-point movement of a vehicle, automatically decoupling the switch machine from the second rail end point. In an embodiment, the first clip assembly and second clip assembly each include a clamp block configured for attachment to a respective one of the first and second rail end points, each clamp block including a housing having a slot formed therein, and a clip configured to be received in the slot. The clip is disengageable from the slot upon application of a generally lateral trailing force to one of the first and second rail end points during the trailing-point movement. In an embodiment, each clip is generally U-shaped and includes a pair of opposed depending legs each having an aperture formed therein adjacent to respective distal ends thereof for receiving a pivot pin, and an upwardly extending third leg. The third leg is configured to be received in the slot in the housing of the clamp block. In an embodiment, the first and second clip assemblies each include a clip retaining mechanism configured to retain the clip within the slot, the clip retaining mechanism including at least one detent ball and a biasing mechanism configured to bias the at least one detent ball into engagement with a corresponding detent recess in the clip.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The terms "including" and "in which" are used as the plain-English equivalents of the respective terms "comprising" and "wherein." Moreover, the terms "first," "second," "third," "upper," "lower," "bottom," "top," etc. are used merely as labels, and are not intended to impose numerical or positional requirements on their objects.

This written description uses examples to disclose several embodiments of the invention, including the best mode, and also to enable one of ordinary skill in the art to practice the embodiments of invention, including making and using any devices or systems and performing any incorporated methods.

As used herein, an element or step recited in the singular and proceeded with the word "a" or "an" should be understood as not excluding plural of the elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the embodiments described herein, it is intended that all of the subject matter of the above description or shown in the accompanying drawings shall be interpreted merely as examples illustrating the inventive concept herein and shall not be construed as limiting the invention.

What is claimed is:

1. An apparatus, comprising:

a clamp block configured for attachment to a rail end point, the clamp block including a housing having a slot formed therein; and a clip configured to be received in the slot;

wherein the clip is disengageable from the slot upon application of a generally lateral trailing force to the rail end point in excess of a threshold value.

2. The apparatus of claim 1, wherein:

the clip is generally U-shaped and includes a pair of opposed depending legs each having an aperture formed therein adjacent to respective distal ends thereof for receiving a pivot pin, and an upwardly extending third leg;

wherein the third leg is configured to be received in the slot in the housing of the clamp block.

3. The apparatus of claim 1, further comprising:

a first clip retaining mechanism configured to retain the clip within the slot, the first clip retaining mechanism including at least one first detent ball and a first biasing mechanism configured to bias the at least one first detent ball into engagement with a corresponding first detent recess in the clip.

4. The apparatus of claim 3, wherein:

the biasing mechanism comprises at least one disc spring.

5. The apparatus of claim 3, wherein:

the first clip retaining mechanism is positioned within the housing of the clamp block.

6. The apparatus of claim 5, further comprising:

a second clip retaining mechanism configured to retain the clip within the slot, the second clip retaining mechanism being positioned within the housing on an opposing side of the clip from the first clip retaining mechanism and including at least one second detent ball and a second biasing mechanism configured to bias the at least one second detent ball into engagement with a corresponding second detent recess in the clip.

7. The apparatus of claim 1, further comprising:

a connecting block engageable with the clamp block, the connecting block being configured to facilitate the attachment of a connecting rod between the clamp block and an opposing clamp block.

8. The apparatus of claim 1, wherein:

the apparatus is configured to couple the rail end point to a switch machine.

9. The apparatus of claim 8, wherein:

the clip is configured to maintain a rigid connection with the clamp block sufficient to transfer a pushing force from the switch machine to the rail end point;

wherein the pushing force of the switch machine is below the threshold value.

10. An assembly, comprising:

a first rail end point;

a second rail end point;

a switch machine configured to selectively move the first rail end point and the second rail end point between first and second alternative positions; and a first clip assembly connecting a first end of the switch machine to the first rail end point, the first clip assembly being configured to transmit a first pushing force from the switch machine to the first rail end point to move the first and second rail end points between the first and second alternative positions, and to automatically decouple the switch machine from the first rail end point during a trailing-point movement of a vehicle.

11. The assembly of claim 10, further comprising:

a second clip assembly connecting a second end of the switch machine to the second rail end point, the second clip assembly being configured to transmit a second pushing force from the switch machine to the second rail end point to move the first and second rail end points between the first and second alternative positions, and to automatically decouple the switch machine from the second rail end point during the trailing-point movement of the vehicle.

12. The assembly of claim 11, wherein:

the first clip assembly and second clip assembly each include a respective clamp block configured for attachment to a respective one of the first and second rail end points, each clamp block including a housing having a slot formed therein, and a clip configured to be received in the slot;

wherein the clip is disengageable from the slot upon application of a generally lateral trailing force to one of the first and second rail end points during the trailing-point movement.

13. The assembly of claim 12, wherein:

each clip is generally U-shaped and includes a pair of opposed depending legs each having an aperture formed therein adjacent to respective distal ends thereof for receiving a pivot pin, and an upwardly extending third leg;

wherein the third leg is configured to be received in the slot in the housing of the clamp block.

14. The assembly of claim 13, wherein:

the first and second clip assemblies each include a clip retaining mechanism configured to retain the clip within the slot, the clip retaining mechanism including at least one detent ball and a biasing mechanism configured to bias the at least one detent ball into engagement with a corresponding detent recess in the clip.

15. The assembly of claim 14, wherein:

the biasing mechanism comprises at least one disc spring.

16. The assembly of claim 15, wherein:

the first and second clip assemblies each include a connecting block engageable with each clamp block, the connecting blocks being configured to facilitate the attachment of a connecting rod between the first clip assembly and the second clip assembly.

17. The assembly of claim 16, wherein:

each clip is configured to maintain a rigid connection with the respective clamp block sufficient to transfer the pushing force from the switch machine to the first or second rail end point.

18. A method, comprising:

connecting a first rail end point to a switch machine via a first clip assembly, the first clip assembly being configured to transmit a first pushing force from the switch machine to the first rail end point to selectively move the first rail end point between first and second alternative positions; and during a trailing-point movement of a vehicle, automatically decoupling the switch machine from the first rail end point.

19. The method according to claim 18, further comprising:

connecting a second rail end point to the switch machine via a second clip assembly, the second clip assembly being configured to transmit a second pushing force from the switch machine to the second rail end point to selectively move the second rail end point; and during the trailing-point movement of the vehicle, automatically decoupling the switch machine from the second rail end point.

20. The method according to claim 19, wherein:

the first clip assembly and second clip assembly each include a clamp block configured for attachment to a respective one of the first and second rail end points, each clamp block including a housing having a slot formed therein, and a clip configured to be received in the slot;

wherein the clip is disengageable from the slot, for the switch machine to automatically decouple from the first rail end point or the second rail end point, upon application of a generally lateral trailing force to at least one of the first or second rail end points during the trailing-point movement.

21. The method according to claim 20, wherein:

each clip is generally U-shaped and includes a pair of opposed depending legs each having an aperture formed therein adjacent to respective distal ends thereof for receiving a pivot pin, and an upwardly extending third leg;

wherein the third leg is configured to be received in the slot in the housing of the clamp block.

22. The method according to claim 21, wherein:

the first and second clip assemblies each include a clip retaining mechanism configured to retain the clip within the slot, the clip retaining mechanism including at least one detent ball and a biasing mechanism configured to bias the at least one detent ball into engagement with a corresponding detent recess in the clip, wherein responsive to the trailing-point movement the at least one detent ball is configured to disengage from the corresponding detent recess, overcoming a bias force of the biasing mechanism, for the clip to disengage from the slot and, thereby, the switch machine to automatically decouple from the first rail end point or the second rail end point.

* * * * *